US008734590B2

(12) United States Patent
Jerg et al.

(10) Patent No.: US 8,734,590 B2
(45) Date of Patent: May 27, 2014

(54) DISHWASHING MACHINE AND METHOD FOR EXECUTING A WASH CYCLE WITH A DISHWASHING MACHINE

(75) Inventors: Helmut Jerg, Giengen (DE); Michael Rosenbauer, Reimlingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 716 days.

(21) Appl. No.: 12/861,848

(22) Filed: Aug. 24, 2010

(65) Prior Publication Data

US 2011/0048465 A1 Mar. 3, 2011

(30) Foreign Application Priority Data

Sep. 3, 2009 (DE) ..... 10 2009 029 187

(51) Int. Cl.
*A47L 15/46* (2006.01)
*A47L 15/00* (2006.01)
*A47L 15/42* (2006.01)

(52) U.S. Cl.
CPC ..... *A47L 15/0023* (2013.01); *A47L 15/4217* (2013.01); *A47L 15/4214* (2013.01)
USPC ..... 134/25.2; 134/57 D; 134/58 D; 134/95.1; 134/95.3

(58) Field of Classification Search
CPC ..... A47L 15/0002; A47L 15/0005; A47L 15/0007; A47L 15/001; A47L 15/0013; A47L 15/0015; A47L 15/0047; A47L 15/4214; A47L 15/4217; A47L 15/48; A47L 14/481; A47L 15/483; A47L 15/486; A47L 15/488
USPC ..... 134/25.1, 25.2
See application file for complete search history.

(56) References Cited

U.S. PATENT DOCUMENTS

| | | | | |
|---|---|---|---|---|
| 4,406,401 | A | 9/1983 | Nettro | |
| 2004/0237908 | A1 * | 12/2004 | Neeser et al. | 122/13.3 |
| 2006/0163372 | A1 * | 7/2006 | Wiemer | 236/12.15 |
| 2007/0151579 | A1 * | 7/2007 | Hooker et al. | 134/18 |

OTHER PUBLICATIONS

Report of Examination CN 201010511213.2 dated Dec. 24, 2013.

* cited by examiner

*Primary Examiner* — Michael Kornakov
*Assistant Examiner* — Ryan Coleman
(74) *Attorney, Agent, or Firm* — James E. Howard; Andre Pallapies

(57) ABSTRACT

A dishwasher including a control device in which a wash program is stored to control a wash cycle for cleaning items to be washed. A water inlet device has a hot-water valve to take in hot water from an external hot-water supply and a cold-water valve to take in cold water from an external cold-water supply. The wash program has a wash step including an intake phase for taking in water via the water inlet device and a spraying phase for spraying the items to be washed with washing liquor containing the water that has been taken in via the water inlet device. The wash program includes a first phase of the intake phase during which the hot water is taken in via the hot-water valve and during which the temperature of the hot water that has been taken is measured by a temperature sensor.

16 Claims, 3 Drawing Sheets

DISHWASHING MACHINE AND METHOD FOR EXECUTING A WASH CYCLE WITH A DISHWASHING MACHINE

BACKGROUND OF THE INVENTION

The present invention relates to a dishwashing machine, in particular a domestic dishwashing machine, comprising a control device, in which at least one wash program for controlling a wash cycle for cleaning items to be washed is stored, and comprising a water inlet device, which has a hot-water valve which can be controlled by the control device and a cold-water valve which can be controlled by the control device, the hot-water valve being provided for taking in hot water from an external hot-water supply, in particular from a hot-water supply fed at least in part by a thermal solar installation, and the cold-water valve being provided for taking in cold water from an external cold-water supply, and the at least one wash program providing at least one wash step which comprises an intake phase for taking in water via the water inlet device and a spraying phase for spraying items to be washed located in a washing chamber with a washing liquor containing water which has been taken in.

BRIEF SUMMARY OF THE INVENTION

The object of the present invention is to improve the efficiency of a dishwashing machine which comprises a hot-water inlet and a cold-water inlet.

The object is achieved in a dishwashing machine of the type specified in the introduction in that the at least one wash program provides a first phase of the intake phase, during which hot water is taken in via the hot-water valve and during which a measurement of a temperature of the hot water which has been taken in is effected by means of at least one temperature sensor arranged downstream of the water inlet device.

In the dishwashing machine according to the invention, the items to be washed, in particular items to be washed, are introduced into a washing container and with the aid of washing liquor cleaned there in a washing process, also referred to as a wash cycle, and subsequently dried. The aim of this is to execute a wash cycle such that a predefined cleaning result and a predefined drying result are achieved as efficiently as possible. This requires a high level of overall efficiency, which is the product in particular of the cleaning efficiency and the drying efficiency. The cleaning efficiency corresponds in particular to the ratio of the cleaning result achieved by means of a wash cycle and the outlay required for this, whereby the outlay may comprise several dimensions such as, for example, the energy required, the water required and/or the time required. Furthermore, the drying efficiency corresponds in particular to the ratio of the drying result achieved by means of a wash cycle and the outlay required for this, whereby here too the outlay may comprise several dimensions such as, for example, the energy required and/or the time required.

A washing liquor is understood here to mean a liquid which is provided for being applied to the items to be washed in order to clean the latter and/or treat it in another way. Thus, washing liquor can, for example, also be provided for heating the items to be washed, which is customary, for example, during a rinsing step. As a general rule, a washing liquor consists predominantly of water. At the same time, the washing liquor may, depending on the operating phase of the dishwashing machine, be enriched with cleaning agents, with cleaning aids, such as for example, rinsing agent and/or with soil which has been removed from the items to be washed.

In the dishwashing machine according to the invention, a control device is provided in which one or more wash programs for controlling a wash cycle for cleaning the items to be washed are stored. The control device may be fashioned as a so-called sequence control system, in particular as an electronic sequence control system. Advantageously, several wash programs are provided, one of which can be selected and started by the user in each case. This makes it possible to adjust the sequence of a wash cycle in particular to the load size, to the load type, to the degree of soiling of the items to be washed and/or to the desired duration of the wash cycle.

In the dishwashing machine, which has both a hot-water inlet and a cold-water inlet, the hot-water inlet has a hot-water valve and the cold-water inlet a cold-water valve. The hot-water valve and the cold-water valve can be controlled separately by a control device of the dishwashing machine according to the invention. It is thus possible during the execution of a wash cycle for hot water and/or cold water to be taken in, depending on a wash program activated. The inventive temperature measurement of the dishwashing machine makes it possible for the wash programs stored there to achieve the efficiency increase possible through the use of hot water in an improved manner.

At least one wash program for cleaning the items to be washed usefully comprises a wash step in which water is taken in, a washing liquor comprising water that has been taken in is formed and the items to be washed located in the washing chamber are sprayed with washing liquor. The wash program usefully provides several such wash steps. These may be, in particular, in this order: a pre-wash step, a cleaning step, an intermediate wash step and a rinsing step. However, wash programs may also be provided in which one or more of these program steps are removed. Wash programs are also possible in which one or more of these program steps are run through several times. Furthermore, a typical wash program comprises a subsequent drying step for drying the cleaned items to be washed.

A pre-wash step is principally aimed at removing coarser soiling from the items to be washed. The purpose of a subsequent cleaning step is to remove soiling from the items to be washed completely. The washing liquor can usefully be replaced with cleaning agent in order to improve the cleaning effect. An intermediate wash step which is now executed serves, in particular, to remove cleaning agent residues which adhere to the items to be washed. A subsequent rinsing step is provided, in particular, for preventing stains on the items to be washed which could be produced by substances dissolved in the water such as, for example, salt and/or lime. To this end, the washing liquor may be replaced during the rinsing step with rinsing agent. The dishwashing machine may provide so-called self-drying, a further function of the rinsing step being to prepare for the subsequent drying step. For this, the items to be washed are heated by the washing liquor during the rinsing step to a high temperature such that in the subsequent drying step drops of water adhering to the hot items to be washed evaporate and condense on the inside of the washing container due to the lower temperature that prevails there.

In order to be able to supply the washing liquor provided for spraying the items to be washed with the respective cleaning agents and/or cleaning aids such as e.g. rinsing agent, the dishwashing machine may have an automatic dosing device.

The cleaning effect of a wash cycle is always greater, the higher the temperatures of the washing liquors of the individual wash steps. In the case of self-drying, the rule that applies to the drying effect is that the latter increases as the temperature of the rinse cycle increases. In order to ensure the temperatures of the respective washing liquor in the individual wash steps under all ambient conditions, the dishwashing machine according to the invention may comprise a preferably electrical heating device.

In the dishwashing machine according to the invention, the water required for executing wash cycles is taken in via a water inlet device which has a hot-water inlet and a cold-water inlet. To operate the dishwashing machine, the hot-water inlet is connected to an external hot-water supply and the cold-water inlet to an external cold-water supply. Such a water inlet device may also be referred to as a bithermal water inlet device.

The hot-water inlet may comprise a hot-water valve and the cold-water inlet a cold-water valve, the hot-water valve and the cold-water valve being controllable independently of one another by the control device. The hot-water valve and/or the cold-water valve may be fashioned as solenoid valves, which have only an open position and a closed position. The use of such valves makes it possible in a simple manner to form a washing liquor which, depending on the respective wash program, comprises hot water from the hot-water supply and/or cold water from the cold-water supply. It would, however, also be possible to use throttle valves, which make it possible to control the through-flow of hot water and/or cold water precisely. In both cases, no external device for controlling the water intake is required.

It can further be provided that the hot-water valve is arranged on an upstream end of the hot-water hose and is fashioned such that it can be fastened to a connecting piece of the external hot-water supply, and/or that the cold-water valve is arranged on an upstream end of a cold-water hose and fashioned such that it can be fastened to a connecting piece of the external cold-water supply. The hot-water valve and/or the cold-water valve may for this purpose have, for example, connection threads which correspond to threads of conventional household water taps. Such valves are also known as aquastop valves.

The arrangement of the hot-water valve and/or of the cold-water valve at the upstream end of the water inlet device has the advantage that, provided the valves are closed, practically no leakage water can escape from the dishwashing machine even in the event of damage. If the valves are fashioned such that they close when they are not activated, the escape of leakage water from a switched-off dishwashing machine is prevented virtually in all cases. In order also to prevent an escape of leakage water from a dishwashing machine that is switched on, a leakage-water sensor for detecting leakage water can be assigned to the sequence control device such that the sequence control device can close the valves if leakage water occurs during operation of the dishwashing machine.

It can further be provided that a downstream end of the hot-water hose and a downstream end of the cold-water hose are connected in a liquid-conducting manner via a connecting piece to an inlet hose, which is connected to a connecting piece fixed to the housing of the dishwashing machine. Such an embodiment of the water inlet device is simple in design and in many cases significantly shortens the length of hose required overall, particularly if the connection points of the external hot-water supply and the external cold-water supply are further away from the installation location of the dishwashing machine, as there is no need in this case for two lengthy parallel hoses.

The use of hot water from an external hot-water supply generally leads to a saving of electrical energy, as the energy required by the electric heating device of the dishwashing machine for heating washing liquor can in this way be reduced. Against the background of generally increased operating costs of domestic heating systems, however, the additional costs of operating the domestic hot-water supply which are generated by the drawing off of hot water in many cases exceed the electricity costs saved. It is therefore sensible to feed the external hot-water supply at least in part by means of a thermal solar installation.

A thermal solar installation is a technical installation for converting solar energy into usable thermal energy. Thermal solar installations usually provide hot water in a temperature range from for example, 40° C. to 70° C., which makes it possible to use the hot water directly for the heating of buildings as well as for service water. Thermal solar installations usually comprise a large number of solar collectors which have an absorber surface which is heated by electromagnetic solar radiation. From there, the heat can be transported by means of a fluid to a heat exchanger which generates the hot water. Alternatively or additionally, the hot-water supply can also be fed by different hot-water generating devices with low operating costs such as, for example, gas burners, heat pumps, combined heat and power plants and others.

In the dishwashing machine according to the invention, the temperature of the hot water provided by the hot-water supply is measured at the start of the intake phase for taking in water for a wash step. This makes it possible to control the further sequence of the wash step in an efficient manner.

Measurement of the temperature of the hot water is effected, whereby hot water is taken in during a first phase of the intake phase via the hot-water valve and the temperature of the hot water that has been taken in is measured by means of at least one temperature sensor which is arranged downstream of the water inlet device. A value of the temperature of the hot water measured in this way represents the temperature which the hot water actually has when it is located inside the dishwashing machine. Such a value of the temperature of the hot water is more meaningful with regard to further control of the wash step than a value which is measured, for example, in the region of the water inlet device or in the region of the external hot-water supply. The reason for this is that any cooling of the incoming hot water on its way into the interior of the dishwashing machine can be allowed for automatically by the invention.

In addition, practically all modern dishwashing machines have a temperature sensor arranged downstream of the water inlet device, which can serve, for example, to control the heating device of the dishwashing machine. This temperature sensor, which is already present, can be used during the intake of water for the wash step for measuring the temperature of the hot water. In this way, there is no need for an additional temperature sensor. Use of an internal temperature sensor of the dishwashing machine for measuring temperature also means that there is no need for exterior transmission lines for transmitting measured values of the temperature of the hot water. In particular, there is no need for such a transmission line that would connect the control device of the dishwashing machine to a control device of the external hot-water supply or to an external measuring device.

The temperature sensor may be an NTC thermistor, also called an NTC resistor, or a PTC thermistor, also called a PTC resistor. The electrical resistance of such components is a function of their temperature. Exploiting this property, an electrical signal corresponding to the temperature of the hot water can be generated with a simple electronic circuit, which signal can be evaluated by the control device of the dishwashing machine. The temperature sensor can in principle be arranged in any region of the dishwashing machine in which thermal contact with the hot water that has been taken in is guaranteed.

A useful further development of the invention provides that the at least one wash program provides a second phase of the intake phase, during which control of the water inlet device is effected on the basis of the measured temperature of the hot water. By means of a control of this kind, it is possible to influence the temperature of the washing liquor being set for the wash step directly. The efficiency of the wash step can be increased by this means, particularly where the temperature of the hot water fed by the external hot-water supply is sharply fluctuating, which can occur, for example, if the external hot-water supply is fed by a thermal solar installation.

According to an advantageous further development of the invention, an intake of hot water and of cold water is provided during the second phase of the intake phase if the temperature of the hot water is greater than an intended temperature of the washing liquor for the wash step. The ratio of hot water taken in and cold water taken in can be adjusted by this means such that the temperature occurring corresponds precisely to the intended temperature of the washing liquor. Use of the heating device of the dishwashing machine in the wash step concerned can be completely dispensed with here. At the same time, only as much hot water as is absolutely necessary is taken from the external hot-water supply. In determining the quantities of hot water and/or cold water to be taken in during the second phase, the quantity of hot water taken in during the first phase can be taken into consideration. Precise adjustment of the temperature of the washing liquor is possible in this way.

According to an advantageous further development of the invention, an intake of hot water but not of cold water is provided during the second phase of the intake phase, if the temperature of the hot water is less than or equal to the intended temperature of the washing liquor for the wash step. In this way, a temperature is arrived at for the washing liquor which corresponds to the temperature of the hot water since no cold water is taken in during the entire intake phase. In this way, the electrical energy requirement of the heating device which is necessary in order to bring the washing liquor to the intended temperature can be minimized. If the temperature of the hot water corresponds to the intended temperature of the washing liquor, then activation of the heating device of the dishwashing machine can even be dispensed with completely.

According to a useful further development of the invention, the first phase of the intake phase precedes the spraying phase. The fact that the items to be washed are not sprayed until after the first phase of the intake phase, i.e. after the temperature of the hot water has been measured, prevents the items to be washed from being sprayed with a washing liquor of unknown temperature. In particular, this can prevent the items to be washed from being damaged due to the temperature of the washing liquor being excessive, which may, for example, occur where a thermal solar installation is being used in conditions of strong solar radiation and where hot-water withdrawal by other consumers is low.

According to a further useful further development of the invention, the spraying phase is provided after the intake of a quantity of cold water determined on the basis of the temperature of the hot water, if the temperature of the hot water is greater than an intended temperature of the washing liquor for the wash step. This prevents the items to be washed from being sprayed with a washing liquor whose temperature exceeds the temperature intended for the wash step.

According to an advantageous further development of the invention, the hot water during the first phase of the intake phase is circulated by means of a circulating pump controlled by the control device. This makes it possible to generate more meaningful measurement values, as local temperature fluctuations in the volume of hot water used for measurement are in this way eliminated. Thus, the circulation of the hot water causes warmer components of the hot water and colder components of the hot water to be mixed so that a temperature measurement that better represents the status of the hot water is produced.

According to a particularly useful further development of the invention, the hot water is circulated during the first phase of the intake phase by being pumped out of a collection sump of the washing chamber by means of circulating pump controlled by the control device and returned to the collection sump via a spray device arranged in the washing chamber such that the items to be washed positioned in the washing chamber remains untouched by the circulated hot water. Practically all modern dishwashing machines have a circulating pump of this kind, which is connected at the inlet end to a collection sump of the washing chamber and at the outlet end to a spray device arranged in the washing chamber, the circulating pump and the spray device being provided primarily for spraying the items to be washed during a spraying phase. Use of a circulating pump and spray device which are already present for circulating the hot water during the measurement phase makes it possible to keep the design cost of implementing the invention low. For circulation, neither an additional circulating pump nor an additional device for returning the circulated water to its starting point are required. In that circulation is effected such that the items to be washed are acted upon by hot water little or not at all during the measurement phase, but remains largely unsprayed, in particular largely dry, damage to the items to be washed caused by excessively hot water can in this way reliably be prevented.

According to a useful further development of the invention, a rotational speed of the circulating pump is controlled during the first phase of the intake phase such that said rotational speed is lower than during the spraying phase. This can in many cases prevent the hot water emerging from the spray system from being able to reach the items to be washed. This aim can at least be supported in this way.

According to a useful further development of the invention, the spray device has several spray elements which can be individually connected via a water diverter to the circulating pump, the water diverter being controlled such that during the first phase of the intake phase the hot water is returned to the collection sump essentially via a spray element arranged in a lower area of the washing chamber. The risk of the circulated hot water reaching the items to be washed during the first phase of the intake phase can be further reduced by this means.

The invention relates furthermore to a method for executing a wash cycle with a dishwashing machine, in particular with a dishwashing machine according to the invention, which comprises a water inlet device for taking in water, the water inlet device being connected, for taking in hot water, to an external hot-water supply, in particular to a hot-water supply fed at least in part by a thermal solar installation, and, for taking in cold water, to an external cold-water supply, at least one wash step being executed in which in an intake phase water is taken in via the water inlet device and in a spraying phase items to be washed located in a washing chamber are sprayed with a washing liquor containing water that has been taken in.

The method according to the invention provides that during a first phase of the intake phase hot water is taken in and the temperature of the hot water which has been taken in is measured by means of at least one temperature sensor which is arranged downstream of the water inlet device.

The method according to the invention enables efficient operation of a dishwashing machine, in particular of a dishwashing machine according to the invention. Further developments of the inventive method are explained in the description of the claimed dishwashing machine.

Other embodiments and further developments of the invention are described in the subclaims. The advantageous embodiments and further developments of the invention explained hereinabove and/or described in the subclaims may be used individually or else in any combination with one another in the dishwashing machine according to the invention and the method according to the invention.

BRIEF DESCRIPTION OF THE DRAWINGS

The invention, its embodiments and further developments thereof and their advantages will be illustrated below with the aid of drawings, in which.

DETAILED DESCRIPTION OF EXEMPLARY EMBODIMENTS OF THE PRESENT INVENTION

Figure 1:
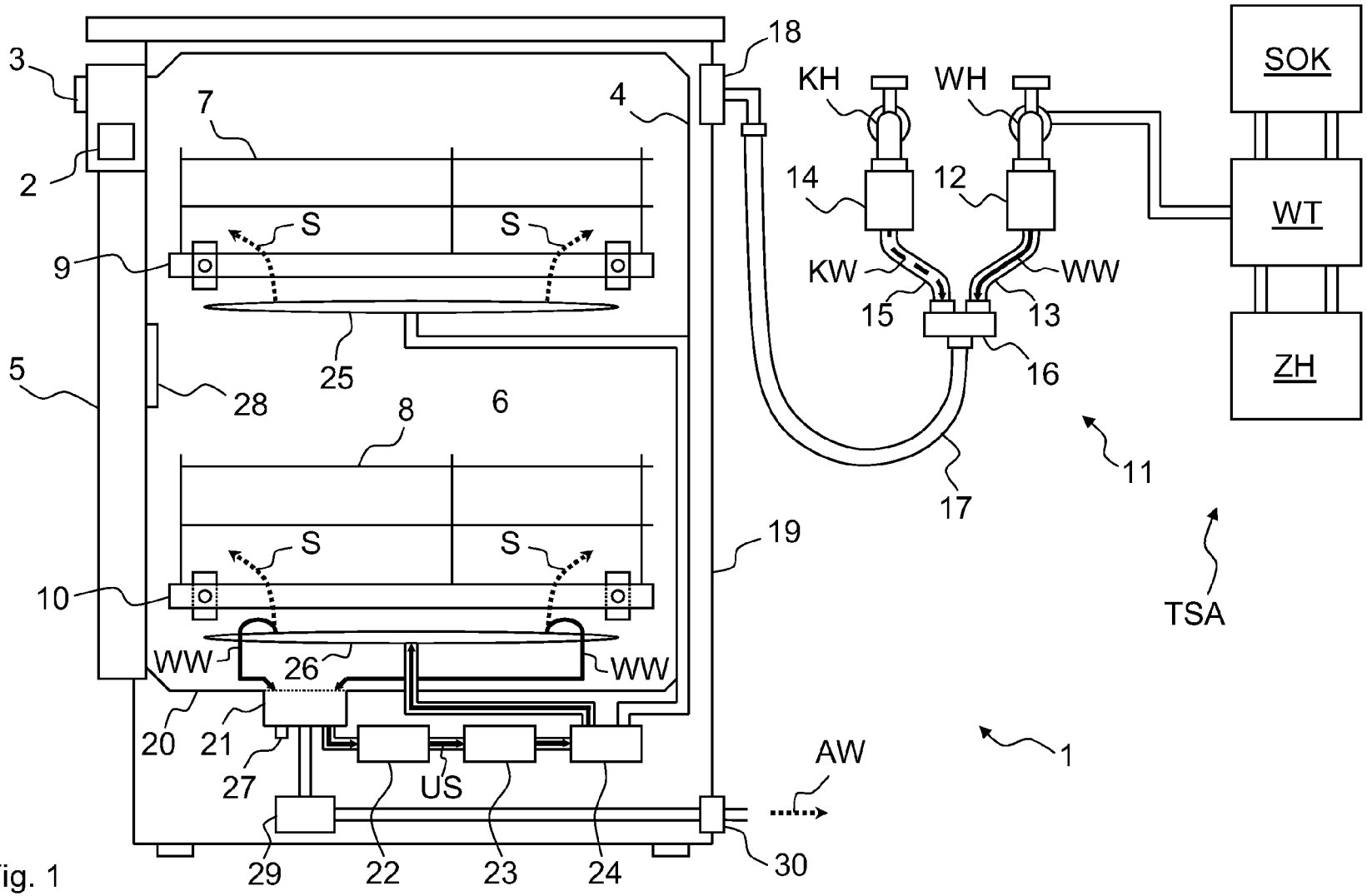
FIG. 1 shows an advantageous exemplary embodiment of a domestic dishwashing machine according to the invention in a schematic side view.

In FIG. 1, only those components of a dishwashing machine which are necessary for understanding the invention are labeled with reference characters and explained. It goes without saying that the inventive dishwashing machine may comprise further parts and modules.

FIG. 1 shows an exemplary embodiment of a domestic dishwashing machine 1 according to the invention in a schematic side view. The dishwashing machine 1 has a control device 2, in which at least one wash program for controlling a wash cycle for washing items to be washed, in particular dishes, is stored. Usefully, several wash programs will be stored so that by selecting a suitable wash program the sequence of a wash cycle controlled by the control device 2 can be adapted, for example to the load size, to the load type, to the degree of soiling of the items to be washed and/or to the desired duration of the wash cycle. The wash program or programs may comprise at least one pre-wash step, at least one cleaning step, at least one intermediate wash step, at least one rinsing step and/or at least one drying step.

An operating interface 3 is assigned to the control device 2, which interface permits an operator of the dishwashing machine 1 to call up and start one of the wash programs.

The dishwashing machine 1 also comprises a washing container 4 which can be sealed by means of a door 5 such that a closed washing chamber 6 for the washing of items to be washed is produced. The door 5 is shown in its closed position in FIG. 1. The door 5 can be brought to an open position by being pivoted about an axis arranged perpendicular to the drawing plane, in which position it is oriented essentially horizontally, enabling items to be washed to be introduced and/or removed. In the exemplary embodiment shown in FIG. 1, the operating device 3 is arranged in a user-friendly manner on an upper section of the door 5. The control device 2 is also positioned there so that the necessary signal connections between the operating device 3 and the control device 2 can be kept short. It is, however, possible in principle to arrange the operating device 3 and/or the control device 2 at a different point. The control device 2 could also be fashioned in a decentralized manner, meaning that it comprises components located spatially apart from one another which are connected via communication means such that they can interact.

The dishwashing machine 1 has an upper dish rack 7 and a lower dish rack 8 for positioning dishes. The upper dish rack 7 is arranged on extensible rails 9 which are fastened respectively to a side wall of the washing container 4. When the door 5 is open, the dish rack 7 can be pulled out of the washing container 4 by means of the extensible rails 9, which facilitates the loading and/or unloading of the upper dish rack 7. The lower dish rack 8 is arranged in an analogous manner on extensible rails 10.

The dishwashing machine 1 comprises furthermore a water inlet device 11, which is represented schematically. The latter has a hot-water inlet 12, 13 and a cold-water inlet 14, 15, the hot-water inlet 12, 13 being provided for taking in hot water WW from an external hot-water supply WH and the cold-water inlet 14, 15 for taking in cold water KW from an external cold-water supply KH. A water inlet device 11 of this type is also referred to as a bithermal water inlet device 11.

The hot-water inlet 12, 13 comprises a hot-water valve 12 and the cold-water inlet 14, 15 a cold-water valve 14. The hot-water valve 12 and cold-water valve 14 can be controlled by the control device 2 and are basically identical in structure. For example, both valves 12, 14 can be fashioned as a solenoid valve. The inlet ends of the valves 12, 14 are respectively fashioned such that they can be fastened to connecting pieces WH, KH of a normal household water supply, for example to water taps WH, KH. The connection can be effected in each case by means of a screw connection, a snap-fit connection or such like. Valves 12, 14 of this kind are also known by the name aquastop valve 12, 14. The bithermal water inlet device 11 can therefore also be referred to as a bithermal aquastop device 11.

The valves 12, 14 are advantageously closed when they are not activated so that the dishwashing machine 1 is isolated from the water supply when in a switched-off state. An escape of leakage water from the switched-off dishwashing machine 1 in the event of a fault can in this way be prevented.

In FIG. 1, in accordance with the intended purpose, the inlet end of the hot-water valve 12 is connected to a hot-water tap WH and the inlet end of the cold-water valve 14 is connected to a cold-water tap KH. The outlet end of the hot-water valve 12 is connected to a hot-water hose 13 and the outlet end of the cold-water valve 14 to a cold-water hose 15, the downstream ends of the hot-water hose 13 and of the cold-water hose 15 being connected to an inlet end of a connecting piece 16. Connected to the outlet end thereof is a shared inlet hose 17 for hot water and cold water, which in turn is connected to a connecting piece 18 on a housing 19 of the dishwashing machine 1. By means of the water inlet device 11, it is consequently possible for hot water WW from an external hot-water supply WH and/or cold water KW from an external cold-water supply KH to be conducted, in an individually controlled manner in each case, into the interior of the dishwashing machine 1.

The hot-water hose 13, the cold-water hose 15 and/or the shared inlet hose 17 can be fashioned as safety hoses with an inner water-bearing pressure hose and an outer sheathing hose, whereby between pressure hose and sheathing hose a leakage water channel can be provided in each case for conducting away any leakage water that might occur. The connecting piece 16 can be fashioned such that the leakage-water channels of the hot-water hose 13, of the cold-water hose 15 and of the shared inlet hose 17 are connected to one another such that leakage water which occurs in the region of the water inlet device 11 during operation of the dishwashing machine 1, is conducted into the interior of the dishwashing machine 1 via the connecting piece 18 fixed to the housing. Here, it can be detected by a water leakage sensor (not shown) so that appropriate measures, such as closing of the hot-water valve 12 and cold-water valve 14, can be initiated.

The dishwashing machine 1 also has components not shown in FIG. 1 which make it possible for the water WW, KW taken in to be conducted from the outlet of the connecting piece 18 fixed to the housing into the washing chamber 6. Provision is usefully made for the water WW, KW taken in to be carried firstly via a water treatment device (not shown) for treatment of the water WW, KW taken in and/or via a heat exchanger for preheating of the water WW, KW taken in, before it enters the washing chamber 6.

A collection sump 21 is fashioned in a floor 20 of the washing container 4, in which sump the water WW, KW introduced into the washing chamber 6 collects due to its gravitational force. The collection sump 21 is connected to a circulating pump 22, with the aid of which a washing liquor S comprising introduced water WW, KW can be pumped out of the collection sump 21 via a heating device 23 to a water diverter 24.

The circulating pump 22, the heating device 23 and the water diverter 24 are controlled during operation of the dishwashing machine 1 by the control device 2.

The circulating pump 22 preferably has a brushless electric motor, preferably a brushless permanent-magnet motor, which can be fashioned as a direct-current motor, an alternating-current motor or a synchronous motor. The rotor of a brushless permanent-magnet motor comprises at least one permanent magnet, the stator on the other hand several electromagnets. These electromagnets are commutated via an electronic control unit. The direction of rotation of the permanent-magnet motor can be clearly defined via the electronic control unit such that the water-conducting parts of the circulating pump 22 can be optimized in flow technology terms with regard to an intended direction of rotation. This produces a high delivery rate at low energy input. In addition, the rotational speed of the motor and thus the delivery rate of the circulating pump 22 can be controlled to requirement by means of the electronic control unit. Furthermore, the brushless permanent-magnet motor can be fashioned as a wet-rotor motor, so that no costly sealing measures are required.

The heating device 23 is provided for heating washing liquor S and is fashioned as a through-flow heater 23. Alternatively or additionally, an openly arranged heating element, for example a heating element arranged in the washing chamber 6 or in the collection sump 21, could also be provided.

The water diverter 24 enables controlled forwarding of the liquor S fed by the circulating pump 22. In the exemplary embodiment, it has two outlets, one of which is connected to an upper rotatable spray arm 25 and a second to a lower rotatable spray arm 26. The spray arms 25 and 26 form a spray device 25, 26 arranged in the washing chamber 6, which spray device enables the application of washing liquor S to items to be washed. However, further outlets could also be provided, for example, to enable the feeding of further spray arms or fixed spray elements. The water diverter 24 can be controlled such that the washing liquor S delivered by the circulating pump 22 is optionally delivered into the washing chamber 6 through none of the spray arms 25, 26, through one of the spray arms 25, 26 or through both spray arms 25, 26.

In order to be able to control the heating device 23 to requirement, a temperature sensor 27 is also provided which sensor is fashioned for detecting the temperature of the washing liquor S being circulated by the circulating pump 22. In the exemplary embodiment, the temperature sensor 27 is arranged in the collection sump 21. It could, however, also be provided at another point where thermal contact with the circulated water WW, KW is possible.

The dishwashing machine 1 may also have a dosing device 28 which is arranged, for example, on the inside of the door 5. The dosing device 28 may be controlled by the control device 2 and makes it possible for cleaning agent and/or cleaning aid, such as for example rinsing agent, to be added automatically to the washing liquor S during a wash cycle. The dishwashing machine 1 comprises furthermore a lye pump 29, with the aid of which washing liquor S that is no longer needed can be pumped as waste water AW out of the collection sump 21 via a waste-water connection 30 to the outside. The waste-water connection 30 may be connected via a waste-water hose (not shown) to an external waste-water disposal plant.

The function of the dishwashing machine 1 is then as follows: The operator first opens the door 5 and loads the dish racks 7, 8 with items to be washed. He then selects a wash program on the operating device 3 and starts this program. The control device 2 then takes over control of a wash cycle on the basis of the wash program activated. The wash program provides at least one wash step in which the items to be washed are sprayed with a washing liquor S in order to treat the items to be washed in that way.

At the start of such a wash step, the hot-water valve 12 is opened in a first phase of an intake phase for water, so as to introduce hot water WW into the washing chamber 6 of the dishwashing machine 1. The hot water WW taken in in this way collects on the floor 20 of the washing container 4 and, due to its gravitational force, runs into the collection sump 21 there. A temperature sensor 27 is assigned to the collection sump 21, which sensor is now in thermal contact with the hot water WW.

In order now to prevent a faulty measurement of the temperature of the hot water WW taken in, which may occur because the hot water WW taken in has an inhomogeneous temperature distribution, the hot water WW is circulated during the first phase as a circulatory flow US. In this way, the hot water WW located in the dishwashing machine 1 is mixed thoroughly. When the hot water WW has been circulated for a sufficient period, the temperature of the hot water WW can be measured by means of the temperature sensor 27 and the measured value used for controlling the water inlet device 11 in a subsequent second phase of the intake phase.

The circulatory flow US is generated by hot water WW being pumped out of the collection sump 21 by means of the circulating pump 22 and pumped via the heating device 23 and the water diverter 24 to the lower spray arm 26. The circulatory flow US is represented in FIG. 1 by solid lines. The heating device 23 is switched off during the first phase of the water-intake phase, so as not to interfere with measurement of the temperature of the hot water WW.

During the first phase of the water-intake phase, the circulating pump 22 is operated at such a low rotational speed that the hot water WW emerging on a top of the spray arm 26 reaches the lower dish rack 8 only a little or not at all. This ensures that during the first phase of the water-intake phase the items to be washed have little or no hot water WW acting upon it inadmissibly but remain largely unsprayed by excessively hot water, in particular remain dry. Damage to the items to be washed caused by excessively high temperature is prevented by this means, including when the hot water WW taken in has a temperature which is significantly higher than the temperature intended for the wash step concerned.

Since, through appropriate control of the water diverter 24 during the first phase of the water-intake phase, the upper spray arm 25 is supplied with little or no hot water WW, there is also no danger that hot water dripping from an upper region of the washing chamber 6 could damage the items to be washed located in the lower dish rack 8.

When the first phase of the water-intake phase is complete, the control device 2 can calculate whether and how much cold water KW as well as whether and how much further hot water WW should be taken in for the respective wash step. Here, use can be made of the experience that normal domestic cold-water supplies KH supply cold water KW with a relatively low range of variation in the temperature of the cold water KW. It would, however, additionally be possible to measure the temperature of the cold water KW.

If the temperature of the hot water WW lies above the intended temperature of the washing liquor S, both cold water KW and hot water WW are taken in in the remaining intake phase. In this way, the resulting temperature that occurs in the interior of the dishwashing machine 1 can fall until it corresponds to the temperature intended for the washing liquor S. When the intake of cold water KW is complete, the rotational speed of the circulating pump 22 is increased so that the washing liquor S now emerges at higher speed from the lower spray arm 26. The washing liquor S can then treat the items to be washed located in the dish rack 8. Appropriate control of the water diverter 24 additionally ensures that in the spraying phase washing liquor S is also discharged at least temporarily from the upper spray arm 25 and can in this way treat the items to be washed located in the upper dish rack 7. The water diverter 24 can in this way be controlled such that water is discharged alternately from the lower and the upper spray arm or simultaneously from both spray arms 25, 26. The discharge of washing liquor S from the spray arms 25, 26 is represented by dotted arrows.

If, on the other hand, the temperature of the hot water WW is lower than the temperature intended for the washing liquor S, then, after the first phase of the water-intake phase, further hot water WW, but no cold water KW, is taken in. The rotational speed of the circulating pump 22 can in this case be increased immediately after the first phase of the water-intake phase, i.e. after the measurement of the temperature of the hot water WW, as there is no fear of damage to the items to be washed due to excessively high temperatures. The early spraying of the items to be washed can in this case reduce the duration of the wash step, since the treatment of the items to be washed ultimately commences earlier. In order to be able to bring the washing liquor S now to the intended temperature, the heating device 23 is switched on accordingly. Nonetheless, its electrical energy requirement is kept to a minimum, as the temperature of the hot water WW which was in any case too low has not been further reduced by the intake of cold water KW. In a final phase of the wash step, the consumed washing liquor S can then be pumped out by means of the lye pump 29 as waste water AW via the waste-water connection 30 to the outside.

Figure 2:
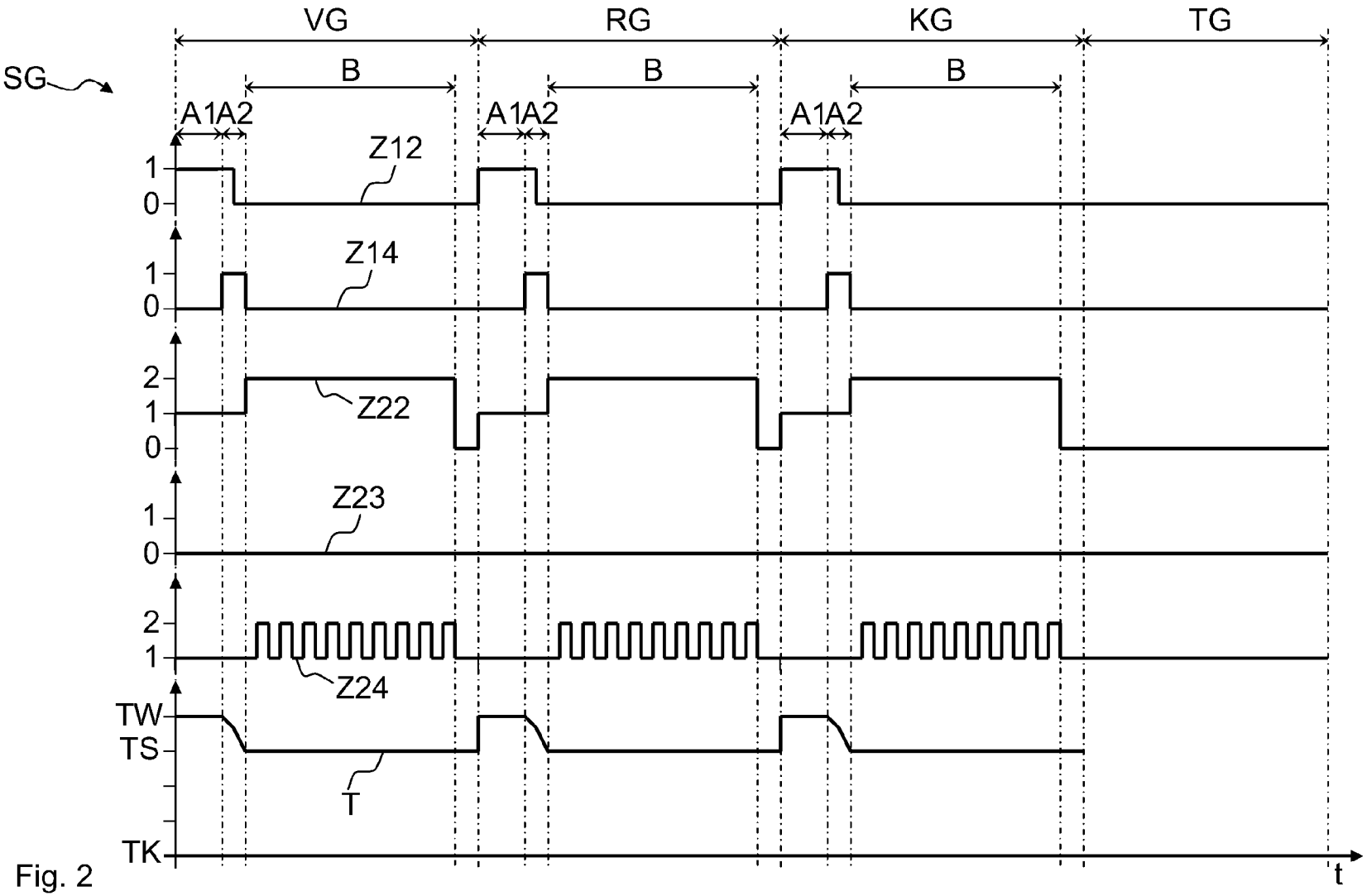
FIG. 2 shows a sample sequence of a wash cycle in the dishwashing machine according to the invention shown in FIG. 1

FIG. 2 shows the time sequence of a sample wash cycle SG according to the inventive method in a dishwashing machine 1 fashioned according to the invention.

On a shared time axis t, a curve Z12 shows the operating state of the hot-water valve 12, a curve Z14 the operating state of the cold-water valve 14, a curve Z22 the operating state of the circulating pump 22, a curve Z23 the operating state of a heating device 23, a curve Z24 the operating state of the water diverter 24 and a curve T the actual temperature of the washing liquor S located in the dishwashing machine 1. The wash cycle SG controlled by a wash program comprises a pre-wash cycle VG, a cleaning cycle RG, a rinse cycle KG and a drying cycle TG. The items to be washed are treated with washing liquor S during the pre-wash cycle VG, during the cleaning cycle RG and during the rinse cycle KG. In the pre-wash cycle VG, which is executed first, an intake phase A1, A2 is provided at the start for the intake of water, i.e. for the intake of hot water WW and/or cold water KW.

The intake phase A1, A2 comprises a first phase A1, during which a measurement of the temperature of the hot water WW is provided. For this purpose, the hot-water valve 12 is brought to an open position "1" so that an inflow of hot water WW into the washing chamber 6 occurs. At the same time, the circulating pump 22 is switched on and operated at a low rotational speed, which is represented in FIG. 2 by the adoption of operating state "1". The water diverter 24 is controlled such that the circulated hot water WW is supplied only to the lower spray arm 26. This type of control of the circulating pump 22 and of the water diverter 24 ensures that the hot water WW circulated during the first phase A1 acts upon the items to be washed in the washing chamber 6 little or not at all. Nonetheless, the hot water WW is circulated in a closed circulatory flow US so as to even out temperature fluctuations within the hot water WW. In this way, a meaningful measurement value can be determined for a temperature TW of the hot water WW by means of the temperature sensor 27. A measurement value of this type is available at the end of the first phase A1 and can be used by the control device 2 for further control of the pre-wash cycle VG, in particular for controlling the remaining second phase A2 of the intake phase A1, A2.

In the example shown in FIG. 2, the temperature TW of the hot water WW determined in this way is higher than an intended setpoint temperature TS of the washing liquor S for the pre-wash cycle VG. At the same time, the temperature TK of the cold water KW is substantially lower than the setpoint temperature TS. It can now be calculated from the measured temperature TW of the hot water WW, from the temperature TK of the cold water KW which is assumed to be known, from the quantity of hot water WW already taken in and from the overall quantity of water required what quantity of cold water KW and what quantity of further hot water WW has to be supplied during the remaining second phase A2 of the intake phase A1, A2 in order to bring the temperature T which occurs to the setpoint value TS.

The appropriate quantities of hot water and cold water are then taken in through appropriate control of the hot-water valve 12 and the cold-water valve 14. In the example shown in FIG. 2, the hot-water valve and the cold-water valve 12, 14 are opened simultaneously during the second phase A2, which is symbolized in each case by the fact that the curves Z12 and Z14 have the value "1" at the start of the second phase A2. It could, however also be provided that the intake of cold water and the additional intake of hot water be executed consecutively. In the case shown, however, the overall time duration of the intake phase A1, A2 can be minimized.

In the example shown in FIG. 2, the actual temperature of the washing liquor S first decreases slowly during the second phase A2 of the intake phase A1, A2, as both hot water WW and cold water KW are taken in. When the required quantity of cold water KW has been taken in, the hot-water valve 12 is closed again so that the curve Z12 assumes the value "0". Only further cold water KW is now taken in so the temperature T of the washing liquor S continues to fall. At the end of the intake phase A1, A2 the cold-water valve 14 is also closed. At this point, the washing liquor S reaches its setpoint temperature TS. Depending on the temperature TK of the cold water KW, the temperature of the hot water WW and the setpoint temperature of the washing liquor, cases may of course also arise in which first the cold-water valve 14 and then the hot-water valve 12 is closed.

When the washing liquor S has reached the intended setpoint temperature TS, the spraying phase B, during which the items to be washed are treated with washing liquor S, can be initiated. To do this, the rotational speed of the circulating pump 22 is increased to its intended nominal speed, which is illustrated by assumption of the operating state "2". The water diverter 24 is controlled such that the lower spray arm 26 and the upper spray arm 25 are alternately supplied with washing liquor S, which is shown by the alternating adoption of the operating states "1" and "2". After the spraying phase B is complete, the circulating pump 22 can be switched off, the alternating activation of the water diverter 24 terminated and the washing liquor S that has been consumed pumped out.

The cleaning cycle RG that now follows and the rinse cycle KG that is executed subsequently are executed according to the same procedure. It goes without saying that for the cleaning cycle RG and/or for the rinse cycle KG a different, in particular a higher, setpoint temperature TS for the washing liquor S could be provided. In the concluding drying cycle TG, the drying of the items to be washed is carried out for example in accordance with the self-drying principle outlined hereinabove.

Figure 3:
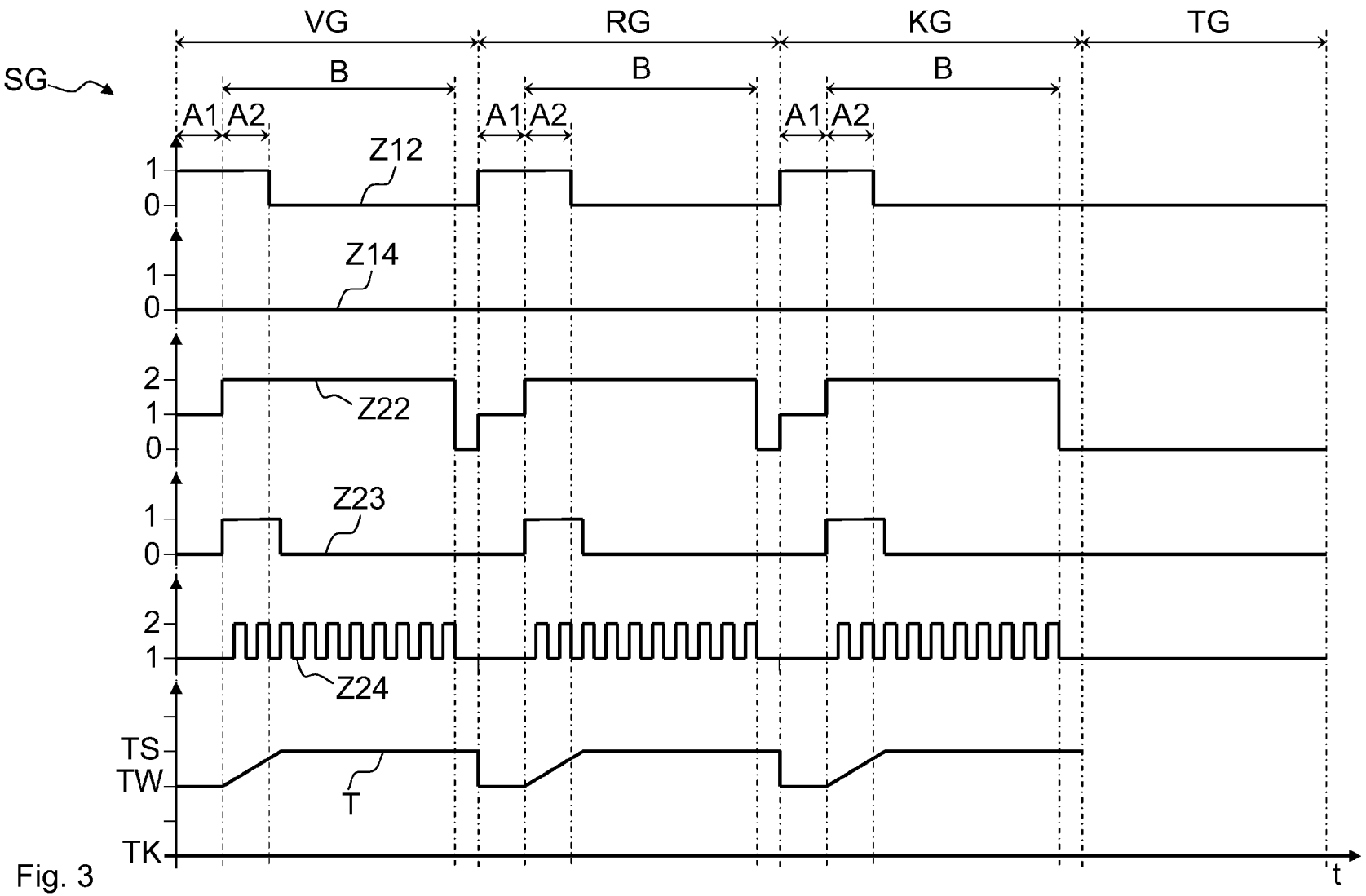
FIG. 3 shows a further sample sequence of a wash cycle in the dishwashing machine according to the invention shown in FIG. 1.

FIG. 3 shows the basic sequence of a wash cycle SG when the temperature TW of the hot water WW is lower than the setpoint temperature TS of the washing liquor S. In this case, as explained for the example shown in FIG. 2, an intake phase A1, A2 is executed, the temperature T of the washing liquor S being measured during the first phase A1. Based on the value of the temperature TW of the hot water WW that is present at the end of the first phase A1, the further intake of water during the second phase A2 of the intake phase A1, A2 is changed compared with the example shown in FIG. 2. So now, during the second phase A2 further hot water WW is taken in only in order to prevent the average temperature of the total water taken in from continuing to fall. Since at the end of the first phase A1 it is certain that the temperature TW of the hot water WW will lie below the setpoint temperature TS for die washing liquor S, the spraying phase B can be initiated immediately after completion of the first phase A1. In order now to bring the washing liquor S to the intended temperature TS, the heating device 23 is switched on temporarily during the spraying phase B so that the curve Z23 temporarily assumes the value "1". The heating device 23 can usefully be switched on immediately at the start of the spraying phase B. The time for switching off the heating device 23 can be determined by means of the temperature sensor 27.

In an advantageous exemplary embodiment of the invention, a dishwashing machine is, in order to save energy, connected, as well as to a cold-water connection, to an external hot-water supply, which in particular is fed wholly or in part with thermal energy from a solar installation. Since the inlet temperature of the hot water from the external hot-water supply installation is provisionally not known, a small quantity of hot water is fed into the dishwashing machine, in particular into the liquid system thereof, circulated via the circulating pump at a low rotational speed and the temperature measured by means of an NTC sensor. Depending on the inlet temperature and the program chosen, hot and/or cold water is then supplied via a bithermal aquastop water-inlet device and in this way reaches the temperature specified in the program. This prevents an excessively high temperature from occurring in the appliance and being able to damage the dishes. This advantage can be implemented in various wash programs, for example, in a delicate program and/or in a quick-wash program.

What is claimed is:

1. A dishwasher, comprising:

a control device in which at least one wash program is stored to control a wash cycle for cleaning items to be washed;

a washing chamber in which the items to be washed are located;

a water inlet device having a hot-water valve controlled by the control device and a cold-water valve controlled by the control device, the hot-water valve to take in hot water from an external hot-water supply and the cold-water valve to take in cold water from an external cold-water supply;

at least one temperature sensor arranged downstream of the water inlet device; and a spraying device for spraying the items to be washed;

wherein the control device is programmed to control the hot-water valve of the water inlet device, during a first phase of an intake phase, to take in only hot water into the washing chamber without spraying the items to be washed with the hot water and to compare a temperature of the hot water measured by the at least one temperature sensor to a predetermined temperature of washing liquor for the wash step before spraying the items to be washed, wherein, if the temperature of the hot water measured by the at least one temperature sensor in the first phase of the intake phase is greater than the predetermined temperature of the washing liquor for the wash step, then the control device is programmed to control the hot-water valve and the cold-water valve of the water inlet device, during a second phase of the intake phase which is subsequent to the first phase of the intake phase, to take in both hot water and cold water into the washing chamber without spraying the items to be washed with the water, and wherein, if the temperature of the hot water measured by the at least one temperature sensor in the first phase of the intake phase is one of less than and equal to the predetermined temperature of the washing liquor for the wash step, then the control device is programmed to control the hot-water valve of the water inlet device, during the second phase of the intake phase, to take in only the hot water into the washing chamber, and wherein the control device is programmed to control the spraying device, during a spraying phase which is subsequent to the intake phase, to spray the items to be washed with the washing liquor containing the water that has been taken into the washing chamber via the water inlet device if the temperature of the washing liquor is equal to the predetermined temperature of the washing liquor for the wash step.

2. The dishwasher of claim 1, wherein the dishwasher is a domestic dishwasher.

3. The dishwasher of claim 1, wherein the external hot-water supply is fed at least in part by a thermal solar installation.

4. A dishwasher, comprising:

a control device in which at least one wash program is stored to control a wash cycle for cleaning items to be washed;

a washing chamber in which the items to be washed are located;

a water inlet device having a hot-water valve controlled by the control device and a cold-water valve controlled by the control device, the hot-water valve to take in hot water from an external hot-water supply and the cold-water valve to take in cold water from an external cold-water supply;

at least one temperature sensor arranged downstream of the water inlet device:

a spraying device for spraying the items to be washed;

wherein the control device is programmed by the at least one wash program to provide at least one wash step, the at least one wash step including:

an intake phase for taking in water via the water inlet device without spraying the items to be washed with the water if the temperature of the hot water is greater than a predetermined temperature of the washing liquor for the wash step; and a spraying phase for spraying the items to be washed with a washing liquor containing the water that has been taken in via the water inlet device if the temperature of the hot water is one of less than and equal to the predetermined temperature of the washing liquor for the wash step, and wherein the at least one wash program includes a first phase of the intake phase during which the hot water is taken in via the hot-water valve and during which the temperature of the hot water that has been taken in is measured by at least one temperature sensor; and a circulating pump controlled by the control device, the control device being programmed to control the circulating pump to circulate the hot water during the first phase of the intake phase without spraying the items to be washed with the hot water.

5. A dishwasher, comprising:

a control device in which at least one wash program is stored to control a wash cycle for cleaning items to be washed;

a washing chamber in which the items to be washed are located;

a water inlet device having a hot-water valve controlled by the control device and a cold-water valve controlled by the control device, the hot-water valve to take in hot water from an external hot-water supply and the cold-water valve to take in cold water from an external cold-water supply; and at least one temperature sensor arranged downstream of the water inlet device, wherein the at least one wash program provides at least one wash step, the at least one wash step including an intake phase for taking in water via the water inlet device and a spraying phase for spraying the items to be washed with a washing liquor containing the water that has been taken in via the water inlet device, wherein the at least one wash program includes a first phase of the intake phase during which the hot water is taken in via the hot-water valve and during which a temperature of the hot water that has been taken in is measured by at least one temperature sensor, and wherein the control device is programmed to control the intake phase such that the hot water is circulated during the first phase of the intake phase such that the hot water is pumped out of a collection sump of the washing chamber by a circulating pump that is controlled by the control device and such that the hot water is returned into the collection sump via a spray device arranged in the washing chamber such that the items to be washed remain untouched by the circulated hot water.

6. The dishwasher of claim 4, wherein the control device is programmed to control a first rotational speed of the circulating pump during the first phase and a second rotational speed of the circulating pump during the spraying phase, and wherein, during the first phase of the intake phase, the control device is programmed to control the first rotational speed of the circulating pump such that the first rotational speed during the first phase of the intake phase is lower than the second rotational speed of the circulating pump during the spraying phase such that the items to be washed remain untouched by the hot water during the first phase and the items to be washed are sprayed by the washing liquor during the spraying phase.

7. The dishwasher of claim 5, further comprising a water diverter, wherein the spray device has a plurality of spray elements, each of the plurality of spray elements connected to the circulating pump via a water diverter, and wherein the water diverter is controlled such that, during the first phase of the intake phase, the hot water is essentially returned into the collection sump via a respective one of the plurality of spray elements that is arranged in a lower area of the washing chamber.

8. A method for executing a wash cycle with a dishwasher having a water inlet device to take in water, at least one temperature sensor arranged downstream of the water inlet device, a washing chamber having a collection sump, a spray device, and a circulating pump, the collection sump, the spray device, and the circulating pump being controlled by a control device, the method comprising:

connecting the water inlet device to an external hot-water supply to take in hot water;

connecting the water inlet device to an external cold-water supply to take in cold water; and executing at least one wash step controlled by the control device, the at least one wash step including:

intaking in an intake phase, the water into the washing chamber via the water inlet device, and spraying, in a spraying phase, items to be washed that are located in the washing chamber with a washing liquor that contains the water that has been taken in to the washing chamber;

wherein the intake phase includes a first phase and a second phase, the second phase following the first phase, the first phase including:

controlling the hot-water valve of the water inlet device to take in only hot water into the washing chamber without spraying the items to be washed with the hot water and comparing a temperature of the hot water measured by the at least one temperature sensor to a predetermined temperature of washing liquor for the wash step before spraying the items to be washed; and the second phase including:

if the temperature of the hot water measured by the at least one temperature sensor in the first phase of the intake phase is greater than the predetermined temperature of the washing liquor for the wash step, then controlling the hot-water valve and the cold-water valve of the water inlet device to take in both hot water and cold water into the washing chamber without spraying the items to be washed with the water and circulating the water by pumping the water out of the collection sump of the washing chamber using the circulating pump and returning the hot water into the collection sump via the spray device arranged in the washing chamber such that the items to be washed remain untouched by the circulated water, and if the temperature of the hot water measured by the at least one temperature sensor in the first phase of the intake phase is one of less than and equal to the predetermined temperature of the washing liquor for the washing step, then the control device is programmed to control the hot-water valve of the water inlet device, during the second phase of the intake phase, to take in only the hot water into the washing chamber; and wherein the spraying phase is subsequent to the intake phase, the spraying phase including spraying the items to be washed with the washing liquor containing the water that has been taken into the washing chamber via the water inlet device if the temperature of the washing liquor is equal to the predetermined temperature of the washing liquor for the wash step.

9. The method of claim 8, further comprising:

supplying hot water to the external hot-water supply at least in part from a thermal solar installation.

10. A dishwasher, comprising:

a control device in which at least one wash program is stored to control a wash cycle for cleaning items to be washed;

a washing chamber in which the items to be washed are located;

a water inlet device having a hot-water valve controlled by the control device and a cold-water valve controlled by the control device, the hot-water valve to take in hot water from an external hot-water supply and the cold-water valve to take in cold water from an external cold-water supply;

at least one temperature sensor arranged downstream of the water inlet device; and a spraying device for spraying the items to be washed;

wherein the control device is programmed by the at least one wash program to provide at least one wash step, the at least one wash step including:

an intake phase for taking in water via the water inlet device without spraying the items to be washed with the water if the temperature of the hot water is greater than a predetermined temperature of the washing liquor for the wash step; and a spraying phase for spraying the items to be washed with a washing liquor containing the water that has been taken in via the water inlet device if the temperature of the hot water is one of less than and equal to the predetermined temperature of the washing liquor for the wash step, wherein the at least one wash program includes a first phase of the intake phase during which the hot water is taken in via the hot-water valve and during which the temperature of the hot water that has been taken in is measured by at least one temperature sensor; and wherein the spray device comprises:

a lower spray element in a lower area of the washing chamber; and an upper spray element in an upper area of the washing chamber, the dishwasher further comprising:

a water diverter for diverting the hot water that has been taken in via the water inlet device to one or both of the lower spray element and the upper spray element, wherein the control device is programmed to control the water diverter to divert the hot water only to the lower spray element during the first phase of the intake phase such that the items to be washed remain untouched by the hot water during the first phase and the hot water is essentially returned into the collection sump.

11. The dishwasher of claim 6, wherein the spray device comprises:

a lower spray element in a lower area of the washing chamber; and an upper spray element in an upper area of the washing chamber, the dishwasher further comprising:

a water diverter for diverting the hot water that has been taken in via the water inlet device to one or both of the lower spray element and the upper spray element, wherein the control device is programmed to control the water diverter to divert the hot water only to the lower spray element during the first phase of the intake phase such that the items to be washed remain untouched by the hot water during the first phase and the hot water is essentially returned into the collection sump.

12. The dishwasher of claim 4, wherein the at least one wash program includes a second phase of the intake phase during which the control device is programmed to control the water inlet device based on the measured temperature of the hot water.

13. The dishwasher of claim 12, wherein, during the second phase of the intake phase, the control device is programmed to separately control the hot-water valve and the cold-water valve such that the hot water and the cold water is taken in if the temperature of the hot water is greater than the predetermined temperature of the washing liquor for the wash step.

14. The dishwasher of claim 12, wherein, during the second phase of the intake phase, the control device is programmed to separately control the hot-water valve and the cold-water valve such that the hot water, but not the cold water, is taken in if the temperature of the hot water is one of less than and equal to the predetermined temperature of the washing liquor for the wash step.

15. The dishwasher of claim 4, wherein the first phase of the intake phase precedes the spraying phase.

16. The dishwasher of claim 4, wherein the control device is programmed to provide the spraying phase after a quantity of the cold water is taken in that is determined based on the temperature of the hot water, if the temperature of the hot water is greater than the predetermined temperature of the washing liquor for the wash step.

* * * * *